United States Patent [19]

Tam et al.

[11] 4,207,499

[45] Jun. 10, 1980

[54] DEVICE AND METHOD OF STARTING A LONG RADIATION SOURCE

[75] Inventors: Sebastian Y. K. Tam; Asoke K. Ghosh, both of Dollard des Ormeaux, Canada

[73] Assignee: RCA Limited, Ste. Anne-de-Bellevue, Canada

[21] Appl. No.: 906,194

[22] Filed: May 15, 1978

[30] Foreign Application Priority Data

Mar. 16, 1978 [CA] Canada ..... 299098

[51] Int. Cl.[2] ..... H05B 41/22; H01J 61/54

[52] U.S. Cl. ..... 315/111.1; 313/198; 313/231.7; 315/111.9; 315/335

[58] Field of Search ..... 315/111, 111.1, 111.9, 315/335, 337; 313/197, 198, 231.7; 331/94.5 PE

[56] References Cited

U.S. PATENT DOCUMENTS 3,222,569 12/1965 Winzeler et al. ..... 315/111.1

3,952,266 4/1976 Girard et al. ..... 331/94.5 PE X

FOREIGN PATENT DOCUMENTS 502434 7/1977 U.S.S.R. ..... 313/198

*Primary Examiner*—Eugene R. LaRoche

*Attorney, Agent, or Firm*—Larson, Taylor and Hinds

[57] ABSTRACT

The present invention relates to a method and apparatus for starting and maintaining a long electrical arc in an arc chamber containing a few atmospheres of pressure of an ionizable gas. An electrical potential difference is maintained between two fixed primary electrodes while a short arc is created between the first primary electrode and a pilot electrode, creating ionized gas. The ionized gas is caused to flow towards the second primary electrode thus creating a region of ionized gas between the two primary electrodes, and hence causing a long arc to be struck. This method does not require relative electrode movement as was the case previously.

14 Claims, 5 Drawing Figures

DEVICE AND METHOD OF STARTING A LONG RADIATION SOURCE

The present invention relates to a method and apparatus for starting and maintaining a long electrical arc in an arc chamber containing a few atmospheres of pressure of an ionizable gas. One of the novel features of the present invention is that there are no movable electrodes required to strike the arc. Such long electrical arcs have utility as sources of heat and light, particularly light of high intensity.

The length of the arc is evidenced by the spacing between the electrodes, hereinafter referred to as the arc path length. When the arc path length is greater than 3 centimeters in length, hereinafter defined as a long arc, conventional arc starting techniques, such as high frequency become impractical. It is also impractical to use high voltage techniques to strike an electrical arc across a long arc path since extremely high voltages (perhaps a few hundred thousand volts or megavolts) are required particularly when the gas atmosphere is under pressure of greater than one atmosphere.

Prior art methods of starting long arcs are as follows. One method sometimes employed to start a long electrical arc is the method of electrode contact followed by separation of the electrodes. An electrical potential is applied to the electrodes which are in contact, and a high current and power density is developed at the contact. This high current and power density developed produces enough heating and ionization in the surrounding gas to render it conducting. The electrodes are then slowly separated, and an electric current may then be maintained. An electrical arc of finite length is drawn by moving the electrodes further apart while the power supply is controlled to maintain a suitable arc current. One disadvantage of this method is that it requires electrode movement which may be inconvenient or restrictive under certain circumstances.

Another prior art method of striking a long arc is that of striking an auxiliary short arc between the main electrodes by high voltage methods followed by separation of the electrodes. This can be done since there is normally little difficulty in striking an electrical arc between electrodes only a few millimeters apart. High voltage sparks are utilized to ignite a short arc between either the two main electrodes or with the help of an auxiliary electrode interposed between the two main electrodes. When the spark, which is essentially low power arc, produces enough ionization, an arc is generated between the main electrodes and may be maintained at a much lower voltage. A longer electrical arc is subsequently drawn by moving the main electrodes apart as at a suitable speed. Again, one of the disadvantages of this method is that relative electrode movement is necessary. Such a method is described in U.S. Pat. No. 3,611,014 issued on Oct. 5, 1971, to Union Carbide Corporation.

Although the high voltage breakdown method may be used to strike a longer electrical arc at lower pressure (much lower than atmospheric pressure) without electrode movement, as the gas pressure in the discharge chamber increases above 1 atmosphere, the required breakdown or sparking voltage is usually inconveniently high. Hence, most of the prior art techniques for striking long arcs in gas atmospheres of greater than 1 atmosphere require mechanical movement of the electrodes.

The present invention discloses a new and experimentally proven device and method (hereinafter referred to as the pilot arc) of starting and maintaining a long electrical arc using fixed electrodes in an arc chamber containing an ionizable gas under the pressure of more than one atmosphere. This method is, of course, entirely suitable for shorter arc applications requiring greater or lesser pressures.

The pilot arc method disclosed by the present invention utilizes the fact that the ionized gas in an arc discharge is highly conducting and hence it is not necessary to maintain a high potential difference across the main electrodes to maintain the arc. Thus to bridge the gap electrically between two widely separated electrodes (tens of centimeters apart), it is advantageous to fill up the gap therebetween with a highly ionized gas. Otherwise, an excessively high voltage is necessary to strike an electrical spark or arc across the electrodes to bridge the gap electrically.

The discharge chamber is preferably provided with a swirling gas vortex along the arc path in order to stabilize the arc and increase the intensity of the light admitted therefrom. Prior art methods can be employed to provide the discharge chamber with the swirling gas vortex. Such methods are described in aforementioned U.S. Pat. No. 3,611,014 issued Oct. 5, 1971, to Union Carbide Corporation, also in U.S. Pat. No. 3,651,358 issued Mar. 21, 1972, to Union Carbide Corporation, and in other patents and sources of reference material.

In accordance with the present invention, there is described a method of creating and maintaining a long electric arc in a discharge chamber, said chamber containing a first electrode, a second electrode, an arc path therebetween, and an ionizable gas, comprising:

(a) maintaining an electrical potential difference between said first and second electrodes;

(b) ionizing means to cause some of said ionizable gas in close proximity to said first electrode to become ionized gas;

(c) flow means to cause some of said ionized gas to flow towards said second electrode wherein when a sufficient concentration of ionized gas is present along said arc path, said electrical potential difference is sufficient to create and maintain a long electric arc between said first and second electrodes along said arc path.

The present invention further discloses apparatus for creating and maintaining a long electric arc comprising:

(a) wall means to define a discharge chamber;

(b) first and second electrodes separated by a long arc path;

(c) potential means to maintain an electrical potential difference between said first and second electrodes;

(d) an ionizable gas located in said discharge chamber;

(e) ionizing means to cause ionizable gas in close proximity to said first electrode to become ionized gas;

(f) flow means to cause some of said ionized gas to flow towards said second electrode;

wherein when a sufficient concentration of ionized gas is present along said long arc path, said electrical potential difference is sufficient to create and maintain a long electric arc between said first and said second electrodes along said arc path.

A preferred embodiment of the present invention will now be described with the aid of the accompanying drawings, in which.

Figure 1:
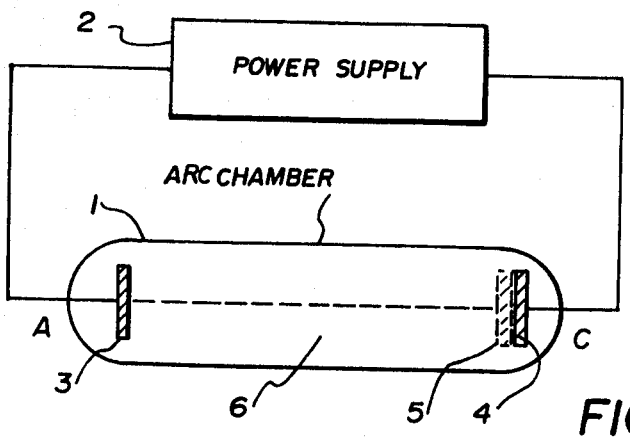
FIG. 1 (PRIOR ART)
FIG. 1 is a block diagram showing an electrical circuit for drawing a long electric arc in accordance with a prior art method.

FIG. 1 shows an arc chamber 1 filled with an ionizable gas 6, preferably one of the noble gases such as Xenon, Krypton or Argon. Xenon, Krypton and Argon are efficient in giving out visible radiation. For uses other than as a light source, Helium, Hydrogen, or Nitrogen, or mixtures of these, may be used. A main power supply 2 is connected across movable anode 3 and cathode 4. Movable anode 3 is initially in position 5 in contact with cathode 4. The power supply 2 is energized to produce high current and power density at the point of contact of the two electrodes. This subsequently produces enough heating and ionization in the surrounding gas to render it conducting. Movable anode 3 may now be moved from its initial position 5 so that the electrodes become separated, and yet an arc will be maintained between the electrodes. The arc may then be drawn by moving anode 3 to a predetermined position while power supply 2 is controlled to maintain a suitable arc current.

Figure 2:
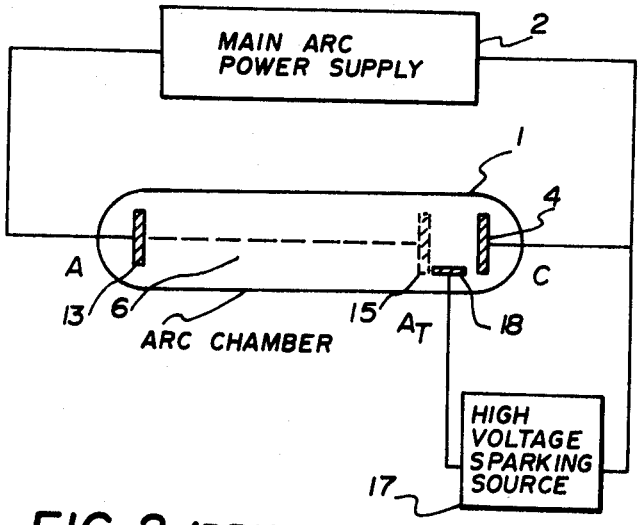
FIG. 2 (PRIOR ART)
FIG. 2 is a block diagram showing an alternate prior art method of starting and maintaining a long electric arc.

FIG. 2 shows an alternate method of striking and maintaining a long arc wherein movable anode 13 and cathode 4 are not in contact. Again, arc chamber 1 contains an ionizable gas 6 of the same type as in FIG. 1. Main arc power supply 2 maintains a potential difference between movable anode 13 and cathode 4. Auxiliary electrode 18 is interposed between cathode 4 and movable anode 13 when movable anode 13 is in its extended position at 15. High voltage sparking source 17 ignites an arc between cathode 4 and auxiliary electrode 18 since they are only a few millimeters apart. When the spark, which is essentially a low power arc, produces enough ionization, an electric arc is generated between movable electrode 13 while in position 15 and cathode 4. Movable anode 13 is then retracted from its initial position 15 to a predetermined position causing a long arc to be drawn between the main electrodes.

Figure 3:
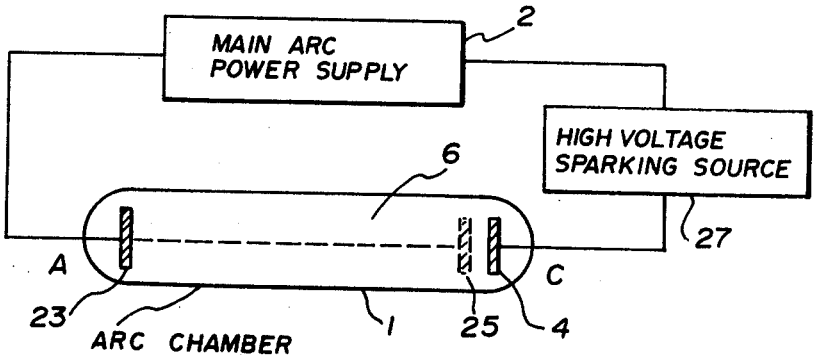
FIG.3 (PRIOR ART)
FIG. 3 is a block diagram showing yet another prior art method of starting a long electric arc.

FIG. 3 is a block diagram showing yet another prior art method of striking and maintaining a long electric arc. Again arc chamber 1 contains an ionizable gas 6 of the same type as in FIG. 1. Main arc power supply 2 maintains a potential difference between movable anode 23 and cathode 4. High voltage sparking source 27 strikes a spark between movable electrode 23 while in position 25 and cathode 4. Such a spark will produce ionization since movable anode 23, while in position 25, is separated from cathode 4 by only a few millimeters. This causes a short arc to be generated between movable anode 23 while in position 25 and cathode 4, which may subsequently be drawn by moving movable electrode 23 to a predetermined position. This method, commonly called the high voltage breakdown method, may be used to strike a longer arc at lower pressures (much lower than atmospheric pressure) without electrode movements. However, as the gas pressure inside arc chamber 1 approaches one atmosphere or higher, the breakdown or sparking voltages required to strike the arc are usually inconveniently high.

Figure 4:
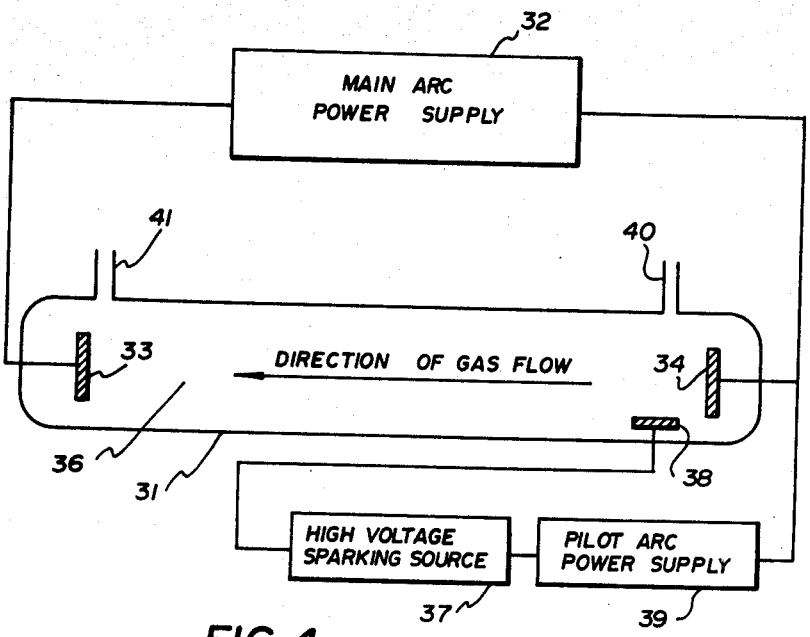
FIG. 4 is a block diagram of an electric circuit arrangement in accordance with the present invention.

FIG. 4 depicts a block diagram of an electrical circuit arrangement for the pilot arc method as disclosed in the present invention. It is well known that ionized gas in an arc discharge chamber is highly conducting and hence does not require the high voltage to maintain an electric arc. Thus , to bridge an electrical gap between two widely separated electrodes (separated by tens of centimeters), it is advantageous to fill the gap with a highly ionized gas. Otherwise, an excessively high voltage, perhaps a few hundred thousand volts or megavolts, is necessary to strike an electric spark or arc between the electrodes to bridge the gap electrically. The main arc electrodes in FIG. 4 are anode 33 and cathode 34. They are both fixed in position. Auxiliary anode 38 is connected to cathode 34 electrically through a high voltage sparking source 37 and a pilot arc power supply 39. To ignite an arc between anode 33 and cathode 34, the main arc power supply 32 is energized and a pilot arc is struck between cathode 34 and auxiliary anode 38 with one of the conventional methods as hereinbefore described. Ionizable gas is flown from gas inlet 40 through arc chamber 31 and out gas exhaust 41. It is preferable to have the gas flow axially along the discharge chamber swirling in the form of a vortex in order to stabilize the arc and increase the intensity of the light produced by the arc. Any one of a number of prior art methods may be used to create such a flow. Ionizable gas 36 is ionized in the region near cathode 34 and auxiliary anode 38 is vortically blown along an arc path between cathode 34 and anode 33 until it reaches gas exhaust 41, which is in close proximity to anode 33. As the ionized gas produced by the pilot arc approaches anode 33, some of the ions recombine and the total degree of ionization is reduced somewhat; a consequence of cooling and other loss mechanisms. However, if the transit time for the ions to travel from auxiliary anode 38 to anode 33 is short enough, or if the rate of ion recombination (i.e. neutralization) is low enough, there will be enough residual ionization to keep the gas conducting. The gas in the region between auxiliary anode 38 and anode 33 is essentially the afterglow of the active region between auxiliary anode 38 and cathode 34 with the actual ionization process takes place. Once the arc path between anode 33 and cathode 34 becomes highly conducting, a high current electric arc will be automatically started and maintained by main power supply 32.

Figure 5:
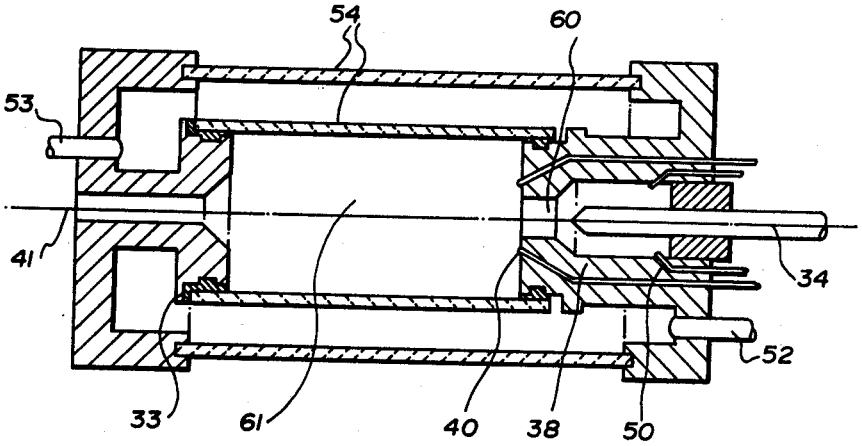
FIG. 5 is a cross section of a device in accordance with the present invention.

The construction of a preferred embodiment of a long arc radiation source with a pilot arc starting mechanism in accordance with the present invention is shown in FIG. 5. The pilot arc assembly consists essentially a liquid cooled cathode 34 preferably made of thoriated tungsten, a pilot arc anode 38 preferably made of copper, a pilot arc gas injection nozzle 50, and a main arc gas injection nozzle 40. Main arc anode 33 is also preferably made of copper. 34 and 33 are the cathode and anode of the main arc respectively. The discharge gas is a suitably chosen ionizable gas, usually an inert gas, which will yield an efficient arc for radiation. Typical arc chamber dimensions are 3.8 cm inner diameter, 5.5 cm outer diameter (of outer jacket), and a 45 cm electrode separation.

Before the radiation source is started, the discharge gas is forced through gas injection nozzle 50 to create vortices both in the pilot arc chamber 60 and in the main arc chamber 61. After being heated in the arc chamber, the gas escapes through main arc anode nozzle 41. The main arc electrical circuitry (not shown) is energized so that an adequate electrical potential is maintained between main arc cathode 34 and main arc anode 33. The pilot arc is then struck with one of the conventional methods of starting an arc as hereinbefore described. This is possible because the separation between the pilot arc cathode 34 and pilot arc anode 38 is small. Once the pilot arc is started, the gas vortex in pilot arc chamber 60 helps to produce a stable arc flame extending far beyond the pilot arc anode 38 into the main arc chamber 61. The gas vortex in the main arc chamber generated and maintained by gas injection nozzle 40 together with a reasonably small chamber diameter helps to confine the pilot arc flame along the chamber axis without being disturbed. When a sufficient concentration of ionized gas produced by the pilot arc flame reaches main arc anode 33, the region between main arc electrodes 34 and 33 becomes conducting. Large electrical current will then be drawn through the main arc circuit power supply 32 producing a long arc in arc chamber 31. Pilot arc circuitry 37 and 39 may now be deenergized.

The pilot arc mechanism as described in FIG. 5 preferably contains double walled liquid cooled transparent jacket 54 and contains consequently a coolant inlet 52 and a coolant outlet 53. An example of a device containing this type of cooling is described in U.S. Pat. No. 3,651,358 issued Mar. 28, 1972, to Union Carbide Corporation. The pilot arc mechanism in FIG. 5 also preferably contains a liquid cooled cathode 34 which may be constructed using prior art technology.

It has been found that it is better to initiate the pilot arc with sparks of a few thousand volts and then maintain the pilot arc momentarily at a few tens of volts and a current of a few hundred amperes until the main arc strikes. In contrast with Nodwell's (U.S. Pat. No. 4,027,185 issued May 31, 1977) Patent which requires up to 100 KV for starting, the pilot arc starting technique does not require excessive voltage nor difficult electrically insulation. Typically, for a 100 KW arc, a 45 cm long arc radiation source in a 4 cm diameter tube and a gas flow of about 20 grams per second, the main arc voltage is about 460 volts and the main arc current is about 220 amps. At 50 KW they are about 460 volts and 120 amps respectively. Below the operating voltage for a given set of operating conditions, the main arc cannot be maintained. Preferably, the pilot arc is operated in a pulsed DC mode which has been found not to require complicated cooling. The main arc can be operated in a DC or a pulsed DC mode.

The embodiments of the invention in which an exclusive property or privilege is claimed are defined as follows:

1. A method of creating and maintaining a long electric arc in a discharge chamber, said chamber containing first and second stationary, widely spaced electrodes defining a long arc path therebetween and an auxiliary electrode in close proximity to said first electrode, said method comprising:

(a) creating and maintaining an electrical potential difference between said first and second electrodes;

(b) introducing a first supply of ionizable gas into said discharge chamber through first gas inlet means adjacent said first electrode and said auxiliary electrode;

(c) creating an electrical potential difference between said auxiliary electrode and said first electrode sufficient to strike an electric arc therebetween so as to ionize said ionizable gas in close proximity to said first electrode to form ionized gas;

(d) introducing a second supply of ionizable gas into said discharge chamber through second gas inlet means downstream of said first gas inlet means so as to direct and maintain a flow of said ionized gas which takes place along said long arc path in a direction towards said second electrode and which exits the discharge chamber through a gas outlet means adjacent said second electrode; said electrical potential difference being sufficient to create and maintain a long electric arc between said first and second electrodes along said long arc path when a sufficient concentration of ionized gas is present along said long arc path.

2. A method according to claim 1, wherein said ionized gas is caused to flow along said long arc path in the form of a gas vortex.

3. A method according to claim 2, wherein said ionizable gas is selected from the group consisting of Krypton, Xenon and Argon.

4. A method according to claim 3, wherein said ionizable gas is under a pressure of at least one atmosphere.

5. A method according to claim 4, wherein the rate of gas flow along said long arc path is about 20 g/sec.

6. Apparatus for creating and maintaining a long electric arc comprising:

wall means for defining a discharge chamber; first and second stationary, widely spaced electrodes in said chamber defining a long arc path therebetween, one of said electrodes being a cathode and the other of said electrodes being an anode; means for creating and maintaining an electrical potential difference between said electrodes; an auxiliary electrode disposed in said chamber in close proximity to said cathode; means for creating an electrical potential difference between said auxiliary electrode and said cathode sufficient to strike an electric arc between said auxiliary electrode and said cathode; gas inlet mens for introducing an ionizable gas into said chamber adjacent said cathode; gas outlet means adjacent said anode for permitting said gas to exit said chamber; an electric arc created between said auxiliary electrode and said cathode causing ionization of the gas adjacent said cathode, and said gas inlet and outlet being arranged to direct and maintain a flow of ionized gas along said long arc path, said electric potential difference between said anode and cathode being sufficient to create and maintain a long electric arc between said anode and cathode when a sufficient concentration of ionized gas is present along said long arc path; said discharge chamber comprising a main discharge chamber and a smaller pilot arc chamber in communicaton with said main discharge chamber through an opening at one end of said main discharge chamber, said gas outlet means being located at the opposite end of said main discharge chamber, said anode being located adjacent said gas outlet means, said cathode and said auxiliary anode being located in said pilot arc chamber, said gas inlet means comprising a first gas inlet in said pilot arc chamber for ionizing the gas between said auxiliary electrode and said cathode and directing a flow of ionized gas into said main discharge chamber through said opening and a second gas inlet in said main discharge chamber adjacent said opening for directing and maintaining the flow of ionized gas along said long arc path.

7. Apparatus according to claim 6, wherein said gas inlet means includes vortexing means for generating and maintaining a gas vortex in said discharge chamber along said long arc path.

8. Apparatus according to claim 7, wherein said ionizable gas is selected from the group consisting of Krypton, Xenon and Argon.

9. Apparatus according to claim 6, wherein said discharge chamber comprises an outer envelope surrounding an inner envelope with a space therebetween wherein a cooling fluid is passed through said space to cool said discharge chamber.

10. Apparatus according to claim 9, wherein the main discharge chamber is of an elongate tubular configuration and wherein said pilot arc chamber is of smaller diameter tubular configuration, arranged in substantially axial alignment.

11. Apparatus according to claim 10, wherein the spacing of the anode and cathode is about 45 cm. and wherein the inner diameter of the main discharge chamber is about 3.8 cm.

12. Apparatus for generating a high intensity source of light radiation, said apparatus comprising:

a discharge chamber comprising an outer elongated tubular envelope surrounding an inner elongated tubular envelope with a space therebetween, said tubular envelopes having light transmitting portions; means for passing a cooling fluid through said space between said inner and outer envelopes to cool said discharge chamber; first and second stationary, widely spaced electrodes located in said inner envelope separated by a long arc path, and a pilot electrode located in said inner envelope in close proximity to said first electrode; means for introducing an ionizable gas into said inner envelope near said first electrode, said gas introducing means including vortexing means for generating and maintaining a gas vortex in said discharge chamber along said long arc path; means for exhausting said ionizable gas from said inner envelope; first potential means for creating and maintaining an electrical potential difference between said first and second electrodes; second potential means for striking an electrical arc between said pilot electrode and said first electrode, an electric arc created between said pilot electrode and said first electrode causing ionization of the gas adjacent said first electrode, said gas inlet and outlet being arranged to direct and maintain a flow of ionized gas along said long arc path and said electric potential difference between said first and second electrodes being sufficient to create and maintain a long electric arc between said first and second electrodes when a sufficient concentration of ionized gas is present along said long arc path; said discharge chamber comprising a main elongated tubular discharge chamber and a smaller tubular pilot arc chamber in substantially axial alignment and in communication with said main elongated discharge chamber through an opening at one end of said main discharge chamber, said gas outlet means being located at the opposite end of said main discharge chamber, said second electrode being located adjacent said gas outlet means, said first electrode and said pilot anode being located in said pilot arc chamber; said gas inlet means comprising a first gas inlet in said pilot arc chamber for ionizing the gas between said pilot anode and said first electrode and for directing a flow of the ionized gas into said main discharge chamber through said opening and a second gas inlet in said main discharge chamber adjacent said opening for directing and maintaining the flow of ionized gas along said long arc path.

13. Apparatus according to claim 12 wherein said ionizable gas is selected from the group consisting of Krypton, Xenon and Argon.

14. Apparatus according to claim 13, wherein the spacing of the first and second electrodes is about 45 cm. and wherein the inner diameter of the main discharge chamber is about 3.8 cm.

* * * * *